United States Patent [19]

Crane

[11] 4,373,284

[45] Feb. 15, 1983

[54] ILLUMINATED HOUSE NUMBER SIGN

[76] Inventor: Donald L. Crane, 309 Chicago Rd., Oswego, Ill. 60543

[21] Appl. No.: 236,336

[22] Filed: Feb. 20, 1981

[51] Int. Cl.[3] ..... G09F 13/04

[52] U.S. Cl. ..... 40/576; 40/578

[58] Field of Search ..... 40/152, 576, 544, 574, 40/572, 579, 575, 564, 542, 152.1, 152.2, 578, 581, 571

[56] References Cited

U.S. PATENT DOCUMENTS

| | | | |
|---|---|---|---|
| 931,382 | 8/1909 | Cairncross | 40/576 |
| 2,163,298 | 6/1939 | Wamser | 40/576 |
| 2,817,914 | 12/1957 | Rosen | 40/576 |
| 3,404,474 | 10/1968 | Johnson | 40/544 |
| 3,414,999 | 12/1968 | Mason | 40/576 |
| 3,553,870 | 1/1971 | Rudolph | 40/576 |
| 3,780,462 | 12/1973 | Pregel et al. | 40/544 |
| 4,292,752 | 10/1981 | Clark | 40/576 |

*Primary Examiner*—Gene Mancene
*Assistant Examiner*—Michael J. Faycik, Jr.
*Attorney, Agent, or Firm*—Hill, Van Santen, Steadman, Chiara & Simpson

[57] ABSTRACT

An illuminated sign for outdoor use is provided which is a frame enclosed by a transparent cover. Grooved tracks are utilized to receive and retain display plates which have light transmitting portions therein in the shape of letters or numbers. A central light source provides illumination and a translucent sheet diffuses the light so that a uniformly bright message appears when the light source is energized and the selected plates are abutted end to end in the tracks. The sign can have a display on more than one side and the display can be in more than one level.

7 Claims, 10 Drawing Figures

FIG 1
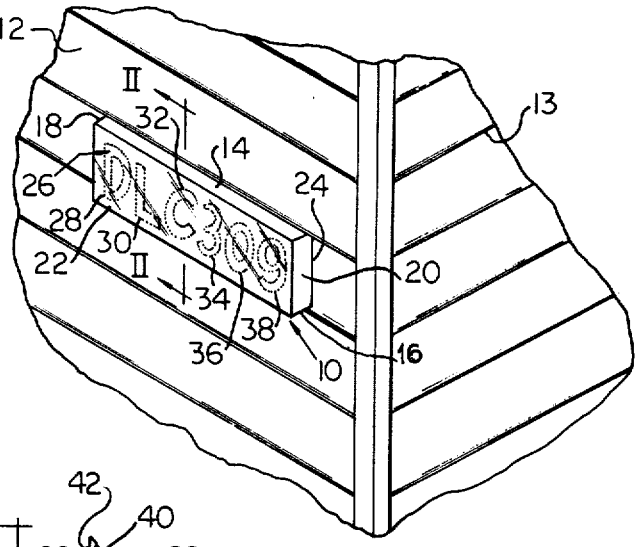
FIG 2
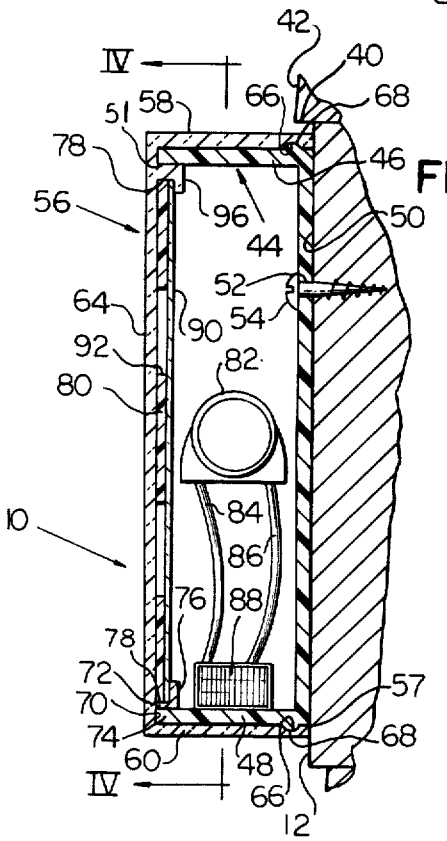
FIG. 4
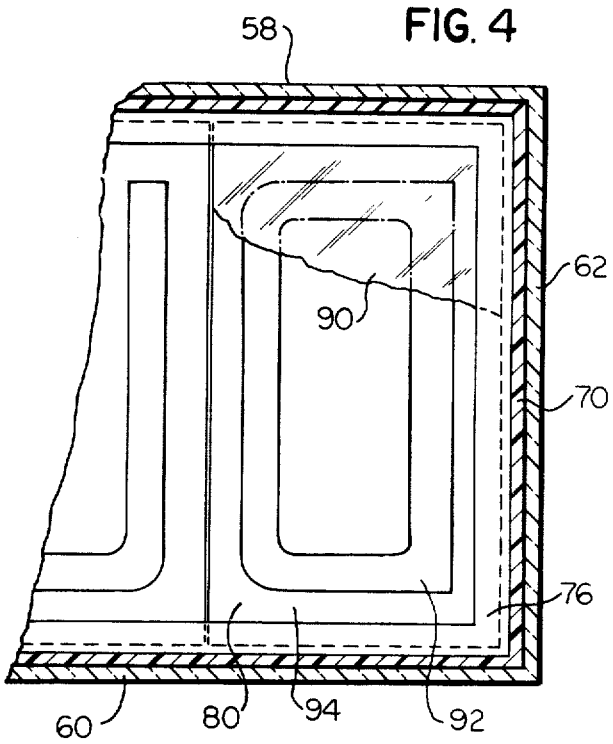
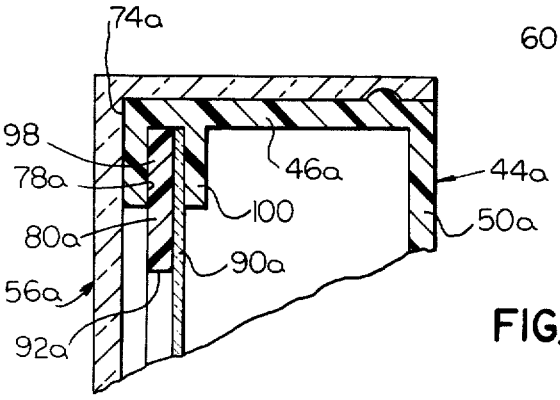
FIG. 3

FIG. 5
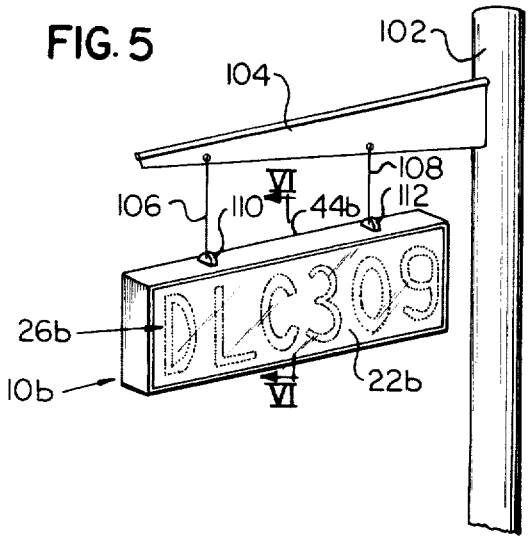
FIG. 6
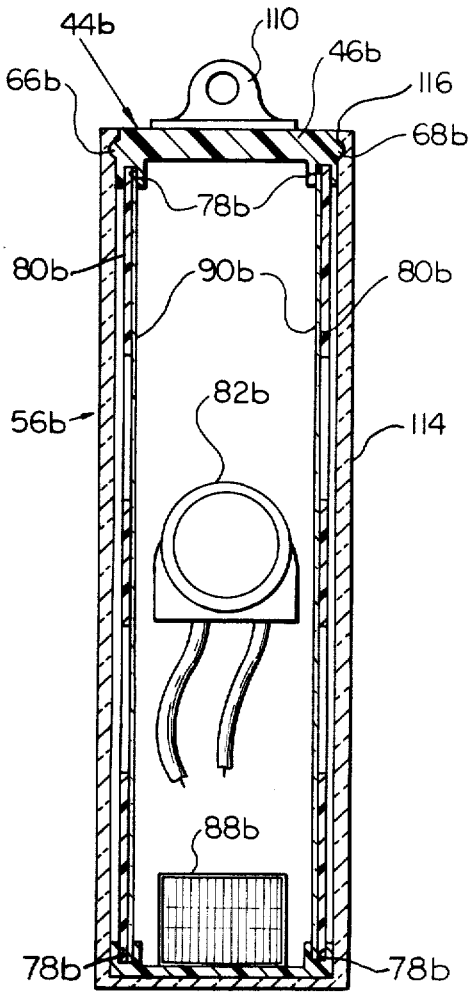
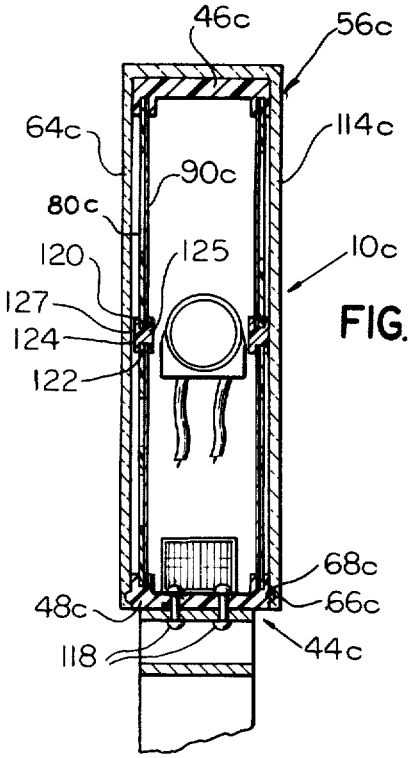
FIG. 8
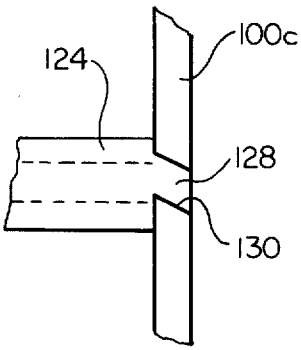
FIG. 9
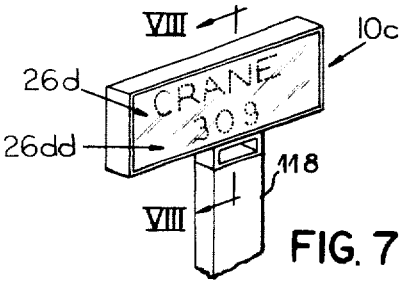
FIG. 7
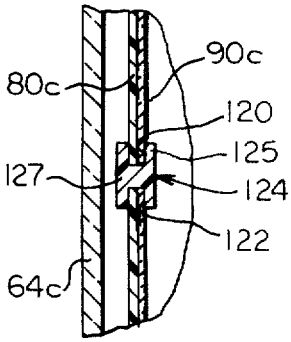
FIG. 10

ILLUMINATED HOUSE NUMBER SIGN

BACKGROUND OF THE INVENTION

1. Field of the Invention

The present invention relates to illuminated signs and more particularly to illuminated signs having changeable numbers and letters which are protected from the weather in connection with outdoor use in displaying house address numbers.

2. Description of the Prior Art

There are many types of illuminated signs known in the art. In some illuminated signs such as neon signs, the light source is carried in and made a part of the letters, numbers or other characters forming the message on the sign. The letters, numbers and other characters are generally exposed and are not readily changeable.

A second type of illuminated sign is comprised of a translucent front face having letters, numbers or other characters painted thereon with opaque paint and has a light source behind the face such that the entire face of the sign, with the exception of the opaque portions, is illuminated thus providing a visible message during the day or night. The message on this type of sign is not easily changeable.

A third type of illuminated sign is that which is generally used for movie theater marquees and other similar uses. This type of sign is comprised of a translucent face having a light source therebehind and generally having some type of track means on the exterior of the face such that numbers, letters and other indicia characters can be retained in a desired sequence in front of the translucent face so as to spell out the message and be visible at night. The letters, numbers and other indicia are changeable with this type of sign, however, they are generally exposed to the weather which may cause visibility problems such as with snow obscuring some of the characters. Also, gusts of wind may blow some characters from their desired locations thereby reducing the usefulness of the signs.

Thus, there exists a need for an illuminated sign fixture which is suitable for outdoor use, having means allowing for a changeable display message and which is protected from the weather.

SUMMARY OF THE INVENTION

The present invention provides for an illuminated sign comprised of a frame with tracks for receiving indicia plates. The indicia plates are flat card-like members with light transmitting portions therein in the shape of letters, numbers or other characters.

A light source is supplied interior of the tracks such that the light will shine out through the plates thereby displaying the character on the plate. A translucent material is provided between the light and the plate to diffuse the light.

A series of plates are positioned in the tracks to spell out a message such as a name or street address number. The message may be displayed on a single row, or on a plurality of rows.

A transparent cover is frictionally held on the frame to seal the interior of the frame from the weather. The plates are generally of a contrasting color from the translucent material making the light transmitting portions of the plates visible during the day while the light source is turned off.

The plates are easily interchangeable on the tracks such that individualized messages may be economically formed and allowing for the message to be easily and readily changed.

DESCRIPTION OF THE DRAWINGS

FIG. 1 is a perspective view of an illuminated sign mounted on the exterior wall of a building.

FIG. 2. is a sectional view of the interior of the sign taken generally along the lines II—II of FIG. 1.

FIG. 3 is a partial view of an alternative embodiment for mounting the tracks from FIG. 2.

FIG. 4 is a partial sectional view of the interior of the sign taken generally along the lines IV—IV of FIG. 2.

FIG. 5 is a perspective view of an alternative embodiment of the illuminated sign which can hang from a post and which has a display area on both sides of the sign.

FIG. 6 is a sectional view of the interior of the sign taken generally along the lines VI—VI of FIG. 5.

FIG. 7 is a perspective view of an alternative embodiment of the sign shown in FIG. 5 which can be mounted on the top of a post and which has a display in two rows.

FIG. 8 is a sectional view of the interior of the sign taken generally along the lines VIII—VIII of FIG. 7.

FIG. 9 is a partial view of the means for attaching the middle track shown in FIG. 8.

FIG. 10 is a partial sectional view of the middle track shown in FIG. 8.

DESCRIPTION OF THE PREFERRED EMBODIMENTS

In FIG. 1, there is generally shown an illuminated sign 10 mounted on the exterior wall 12 of a building 13. The sign 10 is generally rectangular in shape having elongated top and bottom walls 14, 16, short upright side walls 18, 20, a front face 22 having a large surface area, and a rear face 24 mounted against the wall 12 of the building 13.

On the front face 22 there is displayed a message 26 in the form of letters 28, 30, 32 and numerals 34, 36, 38.

The building 13 shown in FIG. 1 has clapboard siding and the sign 10 is sized to have a height approximately the height of one board and is positioned, as is best seen in FIG. 2, up against a protruding portion 40 of an overlapping board 42. This sizing and positioning allows the sign 10 to blend in with the exterior wall 12 of the building 13 and also provides some protection against rain.

The interior construction of the sign 10 is best seen in FIG. 2. A box-like rectangular frame member 44 is comprised of an elongated top wall 46, an elongated bottom wall 48, vertical end walls (not shown) and rear wall 50. The frame member 44 has an open front at 51. The rear wall 50 has at least one hole 52 therein to accommodate an appropriate fastening means 54 such as a screw. The rear wall 50 is to be mounted flush against the exterior wall 12 of the building 13.

A transparent cover member 56 having an open rear at 57, an elongated top wall 58, an elongated bottom wall 60, vertical end walls 62 (second end wall not shown) and a front wall 64 is sized so that the open rear 57 slips over the frame member 44 and is retained frictionally in assembly therewith. There is a sealing rib 66 around the entire circumference of the frame member side walls near the rear wall 50 which engages with a sealing channel 68 formed in the interior of the side walls of the cover member near the open rear 57 such that a water-tight seal is provided between the cover member 56 and the frame member 44.

A slot 70 is formed on the interior of the front wall 64 of the cover member 56 around its perimeter and is defined on one side by the side walls of the cover member 56 and on the other side by a lip portion 72 perpendicular to the front face 64 of the cover 56. A front end 74 of the frame member 44 defining the open front 51 is received in the slot 70.

A short wall 76, integral with the first lip portion 72, is spaced apart from, but parallel to the interior of the front face 64 of the cover 56. The wall 76 and lip 72 form a track defining a groove 78 which extends around the perimeter of the front face 64 of the cover 56. Within this groove 78 is positioned a plurality of plate members 80 as best seen in FIG. 4. The plate members 80 are sized to extend from the grooves 78 near the top of the front face 64 to the grooves 78 near the bottom of the front face 64 so as to be held in a semipermanent position. The plate members 80 are made of a slightly flexible but resilient material such as plastic or thin metal which permits the plate members 80 to be slightly deformed to fit into the grooves 78 and then permits the plate members 80 to resume their normal configuration to be held in the grooves 78.

Referring back to FIG. 2, it is seen that there is a light source 82 which is positioned centrally within the sign 10 and which is supplied with power through lines 84 and 86 by means of a transformer 88. The light source 82 is centrally located such that light falls on the entire interior of the front face 64 of the cover 56. An especially advantageous form of light source is an elongated neon bulb approximately the length of the sign Additionally, there is provided a translucent sheet 90 between the light source 82 and the plate members 80 which defuses the light striking the plate members 80. The plate members 80, as best seen in FIG. 4, may have light transmitting portions or openings 92 formed therein which permit light from the light source 82 to pass through the plate members 80 and through the transparent cover member 56. The light transmitting openings 92 are shaped to represent various letters, numbers, or other characters so that when a series of plates are aligned in the groove 78, a message is displayed on the front 22 of the sign 10. The translucent sheet 90 provides a uniform brightness along the height of the light transmitting portions 92. Some plate members 80 may be without light transmitting portions and thus would represent spaces or blank areas in the message.

As seen in FIG. 2, the translucent sheet 90 may also be carried in the grooves 78 along with the plate members 80 and would lie against the plate members 80. Also, the translucent sheet 90 may be formed in the same dimensions as the plate members 80 and could be permanently fixed to the back side of the plate members 80. Opaque portions 94 of the plate members 80 which surround the light transmitting portions 92 may be of a color which contrasts with the translucent sheet 90 such that the display message would be readily visible through the transparent cover member 56 during daylight hours when the light source 82 is turned off.

Since the cover member 56 is made of a transparent material, light is easily transmitted through the lip portions 76 and 72 and therefore visible from the exterior of the sign 10. This results in a lighted border around the perimeter of the front face 22 of the sign 10 which may be desirable. If the lighted border is not desired, a masking means 96 such as paint or tape may be applied to the rear wall of the second lip portion 76 to prevent the transmission of light through the cover 56 at that point.

An alternative embodiment of the track and groove means is shown in FIG. 3, where it is seen that the top wall **46*a* of the frame member 44*a* has at a front end 74*a* thereof a pair of spaced apart perpendicular wall members 98, 100 forming a track member and which define a groove 78*a* therebetween. Thus, the groove 78*a* is formed as an integral part of the frame member 44*a* rather than as a part of the front cover 56 as shown in FIG. 2. Therefore, the cover 56*a* shown in FIG. 3** does not have any interior lips.

In all other respects, the attachment means between the cover **56*a* and the frame member 44*a* is the same and the placement of the plate members 80*a* and the translucent sheet 90*a* in the groove 78*a* is also the same. As in the embodiment shown in FIG. 2, the groove 78*a* in FIG. 3 is to extend at least along the entire length of the top 46*a* and bottom walls (not shown) of the frame member 44*a* and can extend around the entire perimeter thereof. With this alternative embodiment, the perpendicular wall 100 which is made of an opaque material will prevent any light from passing through the cover member 56*a* around the perimeter of the front face 22 of the sign 10 and thus only the light transmitting portions 92*a* of the plate members 80*a*** will appear illuminated.

Another alternative embodiment is shown in FIG. 5. In this embodiment, the message **26*b* may be displayed on both the front face 22*b* and the rear face 24*b* of the sign 10*b*. The sign 10*b* may be hung from a post 102 by means of an outstretched arm 104 having wires 106, 108 depending downward therefrom which are secured to attachment means 110, 112 such as eyes integral with the top wall 46*b* of the frame member 44*b***.

As seen in FIG. 6, the construction is essentially the same as described above except the cover member **56*b* now has a transparent rear face 114 and the top of the cover member 56*b* is open at 116 to receive the top wall 46*b* of the frame member 44*b*. The sealing channel 68*b* runs around the perimeter of the cover member 56*b* just below the top opening 116. The sealing rib 66*b* now runs around the perimeter of the top wall 46*b* of the frame member 44*b*. The light source 82*b* and transformer 88*b* are carried on the frame member 44*b* thus requiring the connection between the rib 66*b* and the channel 68*b* to support only the weight of the cover member 56*b*. Two sets of grooves 78*b* are provided in the frame 44*b* as described above to accommodate two sets of plate members 80*b* and translucent sheets 90*b***.

FIG. 7 shows another alternative embodiment of the present invention wherein a two sided sign **10*c* is mounted on top of a post 118 and has two message 26*d*, 26*dd* displayed on each side, one being positioned over the other. As seen in FIG. 8, the construction of the sign 10*c* is similar to that shown in FIG. 6, however the cover member 56*c* is inverted to accommodate mounting the frame member 44*c* on its bottom wall 48*c* by appropriate fastening means 118 such as rivets. The sealing rib 66*c* and sealing channel 68*c* are now positioned around the perimeter of the bottom wall 48*c* of the frame member 44*c* however, in all other respects the attachment of the cover member 56*c* to the frame member 44*c*** is identical as described above.

Another set of top and bottom grooves 120, 122 are formed in a track member 124 which has spaced apart walls 125, 127 and which extend across the entire face of the sign **10*c* and which may be positioned equidistant between the top wall 46c and the bottom wall 48c of the frame member 44c. As seen in FIG. 9, the track member 124 is removably secured to the frame member 44c by means of a tongue 128 captured in a groove 130 in the perpendicular frame wall 100c. Thus, the track member 124** can be easily inserted or removed as required.

The plate members 80c and translucent sheets 90c would be sized to be carried between the appropriate spaced apart grooves. The track member 124 may be inserted adjacent both the front face 64c and the rear face 114c to provide for multilevel displays on both sides of the sign 10c. In this manner, any number of levels of messages may be displayed, and any size of display plates may be used by providing an appropriately sized frame member 44c and cover member 56c and appropriately spaced grooves 130 in the wall 100c.

As seen in FIG. 10, the display plate members 80c and defusing sheet 90c are carried in the grooves 120, 122 in the same manner as described above.

For any of the above embodiments, to display a message by using a sign, a person would first select the appropriate display plates having the characters required for the message. Next the transparent cover would be removed from the frame and the display plates would be positioned in the grooves in the appropriate order to correctly display the message. If the grooves extend around the entire perimeter of the frame or cover, the end plates would have to be inserted first and the middle plates would be inserted last, since the sides of the end plates are also secured in position. If the translucent sheet is not attached to the plates, it would also be inserted in the grooves. With the appropriate plates in place, the cover would be slipped back into a locked and weather tight position on the frame and the sign would then be operable.

During daylight hours the message would be displayed due to the contrasting colors of the plates and translucent material and at night the light source could be energized producing a sign in which the characters are illuminated on a dark background. In using the sign for displaying the street address at a home or business, the light source could be wired into the same circuit used for the exterior lighting of the building such that the sign would be "on" whenever the exterior lighting is on. Alternatively, a separate switch could be utilized for energizing the light source used in the sign.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claimed as my invention:

1. An illuminated house address sign comprising:

a rectangular frame member having an elongated top wall, an elongated bottom wall, two end walls connecting the ends of said top and bottom walls, and at least one open face, a transparent rectangular cover member sized to slip over said frame member and to be frictionally retained in assembly therewith by means of a circumferentially sealing rib mating with a circumferential channel such that said open face on said frame member is enclosed and made weather tight, at least one track member extending around the interior of said frame and cover assembly adjacent said open face, said track member having a groove therein oriented perpendicular to the said walls of said frame and open to the interior of said frame, at least one selectively removable track member extending across said open face of said frame member in the same plane as said fixed track member and parallel with said bottom wall, said track member forming pairs of opposed grooves, a plurality of plate members sized to be received in said opposed groove pairs, said plate members having light transmitting portions therein in the shape of individual letters and numbers, a light source interior of said track members, a translucent sheet member sized to be received in said opposed groove pairs interior of said plate members to diffuse the light from said light source, whereby a single or multi-level message can be displayed on at least one face of said sign by inserting or removing track members and placing appropriate plate members in abutting sequence in said opposed groove pairs to spell out the desired message.

2. The device of claim 1 wherein said selectively removable track is insertable in a plurality of vertical locations whereby a single or multi-level message of any desired height can be displayed.

3. The device of claim 1 wherein said rectangular frame member has a plurality of open faces each of which is enclosed and made weather tight by said transparent rectangular cover member and where said integral track members and removable track members extend across each of said open faces whereby said single or multi-level message can be displayed on each open face of said sign by inserting or removing track members and placing appropriate plate members in abutting sequence in said opposed groove pairs to spell out the desired messages.

4. The device of claim 1, wherein said plate members are of a color contrasting with said translucent sheet whereby said display is readily visible during daylight hours.

5. The device of claim 1, wherein the track members are formed as an integral part of the frame member.

6. The device of claim 1, wherein the track members are formed as an integral part of the cover member.

7. The device of claim 1, wherein a lighted border is provided around the perimeter of the open face.

* * * * *